US006025803A

United States Patent [19]

Bergen et al.

[11] Patent Number: 6,025,803

[45] Date of Patent: Feb. 15, 2000

[54] LOW PROFILE ANTENNA ASSEMBLY FOR USE IN CELLULAR COMMUNICATIONS

[75] Inventors: Scott P. Bergen, Davie, Fla.; Frederick A. Robertson, Allen, Tex.

[73] Assignee: Northern Telecom Limited, Montreal, Canada

[21] Appl. No.: 09/045,559

[22] Filed: Mar. 20, 1998

[51] Int. Cl.[7] ..... H01Q 1/38

[52] U.S. Cl. ..... 343/700 MS; 343/754; 343/911 L

[58] Field of Search ..... 343/700 MS, 754, 343/911 L; H01Q 1/38

[56] References Cited

U.S. PATENT DOCUMENTS

| | | | |
|---|---|---|---|
| Re. 291,979 | 5/1977 | Munson | 343/700 MS |
| 3,761,936 | 9/1973 | Archer et al. | 343/754 |
| 4,962,383 | 10/1990 | Tresselt | 343/700 MS |
| 5,160,936 | 11/1992 | Braun et al. | 343/700 MS |
| 5,384,458 | 1/1995 | Hilliard et al. | 343/911 L |
| 5,628,053 | 5/1997 | Araki et al. | 343/700 MS |
| 5,708,444 | 1/1998 | Pouwels et al. | 343/700 MS |
| 5,793,258 | 8/1998 | Lange | 343/700 MS |
| 5,841,401 | 11/1998 | Bodley et al. | 343/700 MS |

*Primary Examiner*—Don Wong
*Assistant Examiner*—Hoang Nguyen
*Attorney, Agent, or Firm*—John D. Crane; Andrew Mitchell Harris; Andrew J. Dillon

[57] ABSTRACT

The low profile antenna assembly comprises a generally rectangular frame member housing a planar antenna. A radar absorbing material is attached to the front side of the housing with a radome covering the front side of the planar antenna and attached to the frame member. The planar antenna is a microstrip array fed by a beam forming network that uses either delay lines or phase shifters to electronically steer the antenna pattern horizontally and vertically. The antenna assembly is weatherproofed, painted and flush mounted against a building surface for camouflaging the antenna assembly from observers at a distance.

21 Claims, 6 Drawing Sheets

LOW PROFILE ANTENNA ASSEMBLY FOR USE IN CELLULAR COMMUNICATIONS

BACKGROUND OF THE INVENTION

1. Technical Field

The present invention relates in general to reduced sidelobe antenna array assemblies, and in particular to low profile antenna array assemblies for use in cellular communications having low visual profile site capabilities when mounted against a building surface.

2. Description of the Related Art

In cellular communications it is common practice to utilize a three (3) sector antenna configuration for a given base station where a sector refers to the area coverage provided by the beamwidth of the main beam (also known as the mainlobe) of the antennas' radiation pattern. The use of pointing the mainlobe of an antenna for a given sector has produced significant advantages in modern day cellular system technologies. More specifically, sectorization reduces co-frequency interference, allowing more efficient frequency planning and the associated capacity improvements in Advanced Mobile Phone Systems (AMPS), Time Division Multiplexed Access (TDMA), and Global System Mobile Communications (GSM) systems. Additionally, for Code Division Multiplex Access (CDMA) cellular systems, there is a direct capacity increase associated with each new sector.

However, when considering utilizing more than three (3) sectors of coverage, the additional sectors increase in capacity is not as efficient due to overlapping coverage from the antennas' radiation pattern into the additional sectors. More particularly, current beamwidth cellular antennas produce significant sidelobes, which in turn scatter energy into the adjacent sectors, and effectively reduce the capacity efficiency of these additional sectors. In most cases, the sidelobe peak gain is within twelve (12) dB of the main beam peak gain and in many cases the sidelobes gain can be five (5) to six (6) dB below the mainlobe gain of the antenna which from a system performance standpoint may be unacceptable.

Furthermore, cellular antenna assemblies are quite large due to current antenna design constraints when designing in the cellular phone frequency range of 800 Mhz and 1900 Mhz. This results in antennas being installed in urban areas and onto buildings with bulky and unsightly installation hardware such as long masts. Additionally, current antennas are designed with fixed radiation patterns having the main beam at boresight resulting in complicated and expensive mounting brackets that must incrementally swivel in the horizontal and vertical planes to achieve the sector coverage desired.

Because of the continued widespread use of cellular communications, it is desirable to implement relatively narrow beamwidth sectored antenna configurations having low sidelobes for cellular phone applications in the 800 MHz and 1900 MHz bands with minimal coverage overlap between sectors. Additionally, it is desirable to have a low profile antenna that can be electronically scanned thereby eliminating the need for pointing bracketry and that can be flush mounted and camouflaged against a building surface making it virtually invisible to observers at any significant distance. The subject invention herein solves all these problems in a new and unique manner which has not been part of the art previously.

SUMMARY OF THE INVENTION

An object of the present invention is to provide an antenna assembly suitable for building installations in urban areas where traffic handling concerns exist.

Yet a further object of the present invention is to provide an antenna assembly having low visual profile site capability without the associated cost of cover panels, decoration, and supporting structure.

Still another object of the present invention is to provide an antenna assembly having off boresight scanned capability allowing 360 degree coverage with flat mounting regardless of building structure orientation.

Still another object of the present invention is an antenna assembly of the character described which implements either 2, 3, 6, 9 or 12 sectored cellular base stations while realizing the associated capacity improvement with minimal efficiency loss due to sector coverage overlap.

Accordingly, it is an object of the present invention to provide an improved low profile antenna assembly having low sidelobes, a permanently steered narrow beam for network optimization, which is inexpensive to manufacture and sturdy in construction for use in cellular phone communications.

The low profile antenna assembly of the present invention comprises a generally rectangular frame member housing a planar antenna. A radar absorbing material is attached to the back side of the planar antenna with a radome covering the front side of the planar antenna and attached to the frame member. The planar antenna is a microstrip array fed by a beam forming network that uses either delay lines or phase shifters to electronically steer the antenna pattern horizontally and vertically. The antenna assembly is weatherproofed, painted and flush mounted against a building surface for camouflaging the antenna assembly from observers at a distance.

The above as well as additional objects, features, and advantages of the present invention will become apparent in the following detailed written description.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of an illustrative embodiment when read in conjunction with the accompanying drawings, wherein:

DETAILED DESCRIPTION OF ILLUSTRATIVE EMBODIMENT

Figure 1:
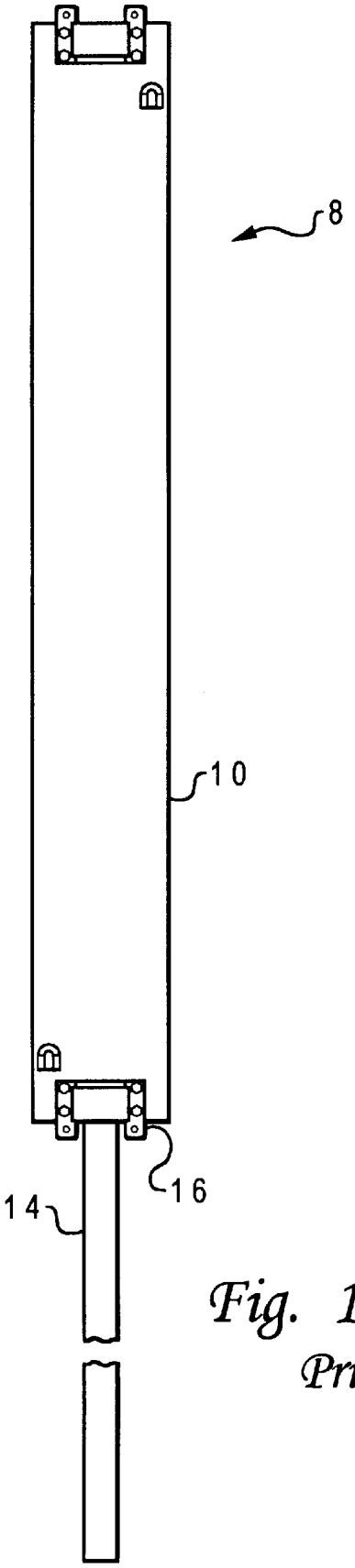
Fig. 1 Prior Art
FIG. 1 is a front view of a prior art antenna assembly used in cellular communications.
Figure 2:
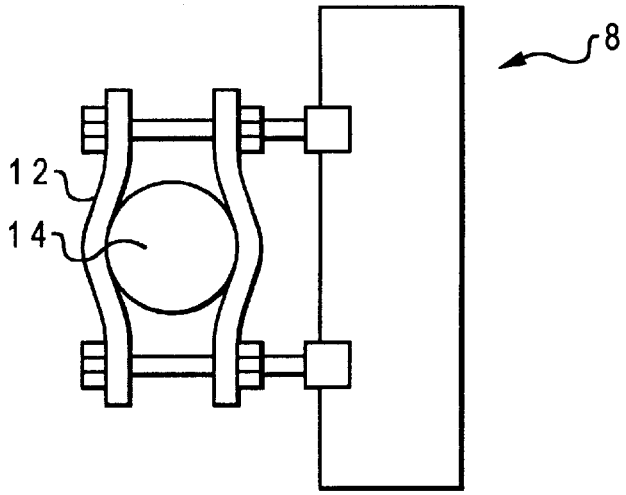
Fig. 2 Prior Art
FIG. 2 is a top view of the prior art antenna assembly illustrated in FIG. 1.

Referring now to the drawings wherein like reference numerals refer to like and corresponding parts throughout, a prior art antenna assembly for use in cellular communications is shown in FIGS. 1 and 2. Referring now to FIGS. 1 and 2, the prior art antenna assembly 8 comprises an elongated antenna housing 10 supported by a long mast 14 which is bolted to the side of a building structure and holds the antenna housing 10 by a plurality of clamps 12. As shown in FIG. 1, the prior art antenna assembly 8 is quite large and unsightly due to current antenna designs used for the cellular phone frequency range of 800 Mhz and 1900 Mhz. The prior art antenna (not shown) located within antenna housing 10 is designed with a fixed radiation pattern resulting in an expensive mounting bracket 16 that incrementally swivels in the horizontal and vertical planes to achieve the sector coverage desired.

Figure 3:
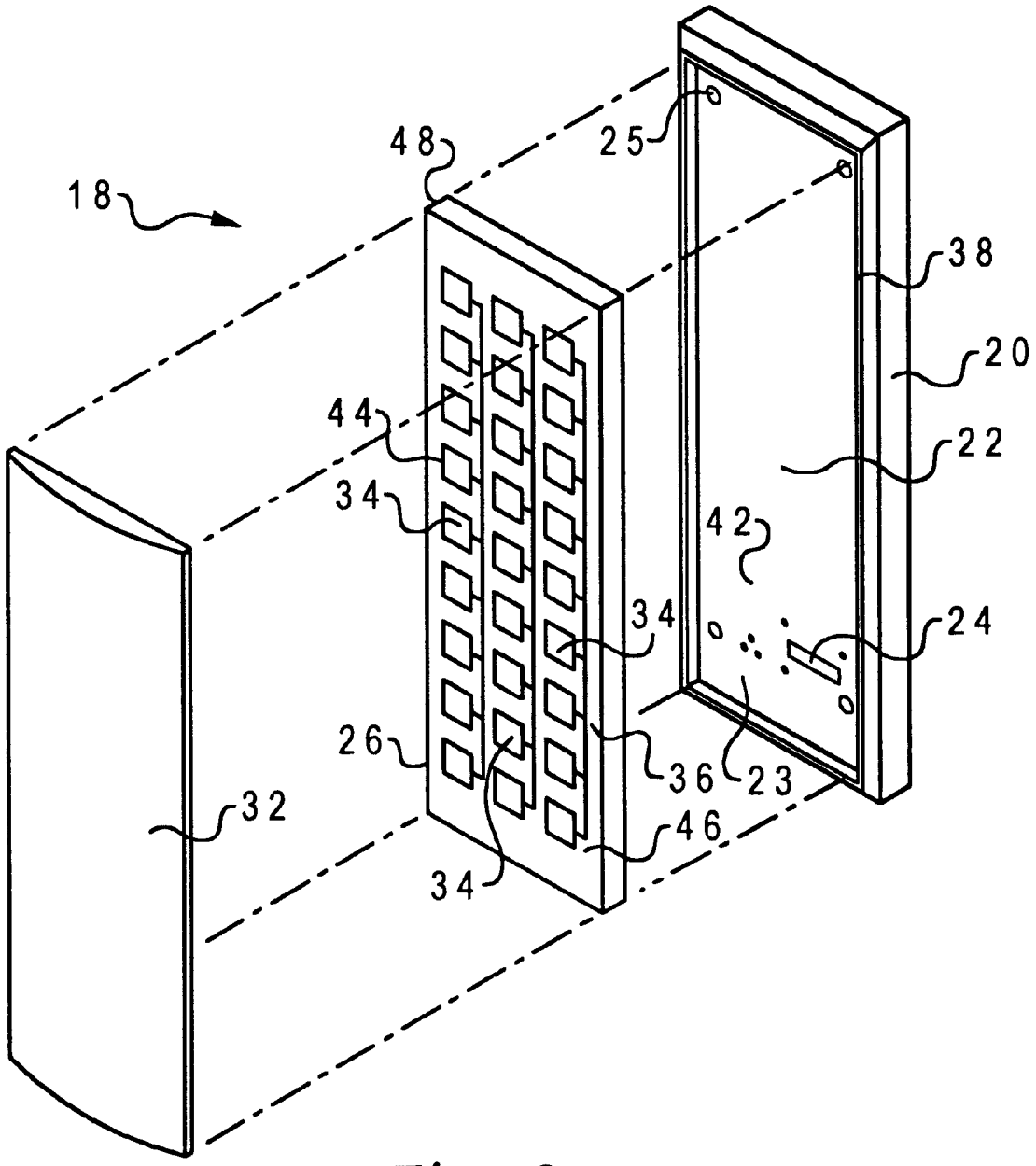
FIG. 3 is an exploded isometric view of a low profile antenna assembly of the present invention.

The low profile antenna assembly of the present invention is generally indicated by numeral 18 and solves all of the limitations of the above-described prior art antenna assembly 8. Referring now to FIG. 3, the low profile antenna assembly 18 comprises a generally rectangular frame member 20 having a back panel 22 with the back panel 22 further defining an access hole 24 to allow for an external RF connection and defines holes 25 for use in mounting against a building wall. The generally rectangular frame member 20 may be fabricated out of fiberglass or similar light weight material. Referring once again to FIG. 3, housed within the rectangular frame member 20 is an antenna planar array 44 having front 46 and back sides 48. On the front side 46 of antenna planar array 44 are a plurality of copper etched radiating elements 34 on a dielectric substrate 26, as will be more fully described below. The back panel 22 is covered with a radar absorbing material 42. A fiberglass radome 32 covers the front side 46 of the antenna planar array 44 and is attached to the rectangular frame member 20 completing the low profile antenna assembly 18. Additionally, the antenna assembly 18 may be further weatherproofed by placing a rubber gasket 38 between the radome 32 and along an edge of the frame member 20.

Figure 4:
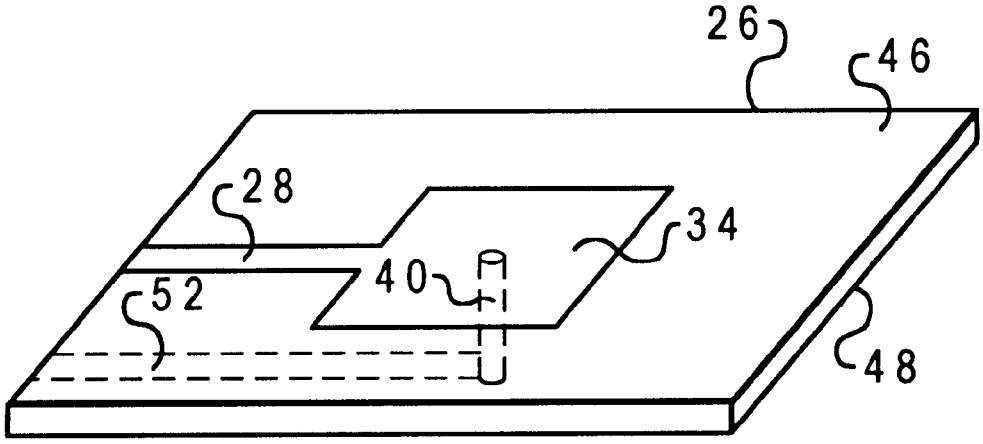
FIG. 4 is an isometric view of a radiating element shown in FIG. 3.

Referring now to FIGS. 3 and 4, in the preferred embodiment the antenna planar array 44 is a rectangular flat plane microstrip antenna 36 utilizing surface etching on a printed circuit board substrate 26 to form the radiating elements 34. By way of example but not of limitation, for low frequency application the microstrip antenna 36 of the present invention may have a size of up to 2×2 meters in height and width. The height and width dimensions being determined by the desired radiating pattern wherein the antenna element spacing is ½ wavelength based on the frequency of operation and the antenna gain is determined by the size of the array 44. In the preferred embodiment, the antenna elements 34 are simple square copper etched elements 34 etched on the front side 46 of the printed circuit board substrate 26 and are connected to the RF input by etched copper striplines 28 to form an array. However, other element types are possible, such as circular, bow tie, triangle, hexagon and other element types known in the art. Additionally, cavity backed slot elements or other types of low profile radiating elements known in the antenna arts may be used.

Referring once again to FIG. 3, applying the radar absorbing material 42 to the front side of the back panel 22 allows the array 44 to be directly bolted to a wall. The radar absorbing material 42 provides better than 30 dB of damping at the frequency of the array 44, eliminating back lobe reflections that can disrupt the desired array radiation pattern. The radar absorbing material 42 is very thin and attached to the substrate by staples, rivets, epoxy or like attachment means with a total thickness of less than ½ inch. Also, the weatherproofing may be accomplished by a spray application of RF transparent material applied directly to the front and back of the array structure including the radar absorbing material. This embodiment eliminates the need for a radome gasket and placing drain holes in the frame member. However, a plurality of drain holes 23 are provided to drain water during wet weather conditions. This type of antenna 44 is particularly suited to building applications. The antenna planar array 44 is large but flat with built-in RF isolation (the radar absorbing material 42 backing) allowing direct mounting to a building wall, parapet or penthouse.

Figure 4A:
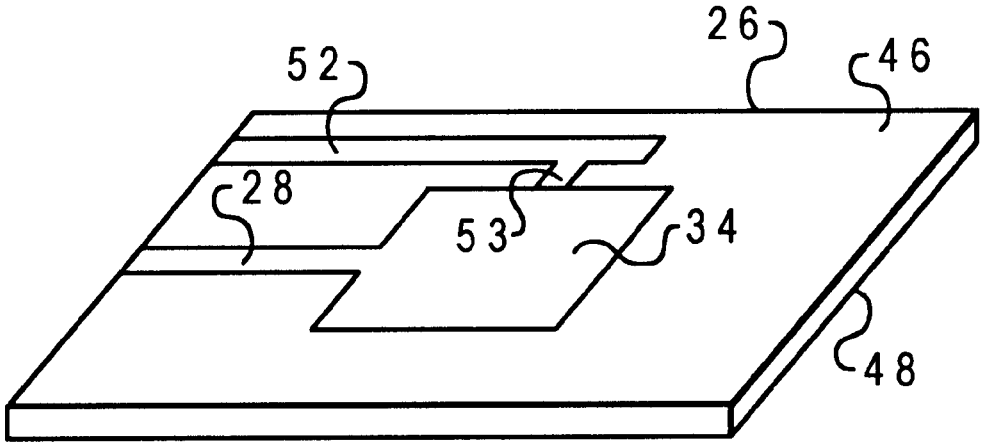
FIG. 4A is an isometric view of another preferred embodiment shown in FIG. 4.
Figure 5:
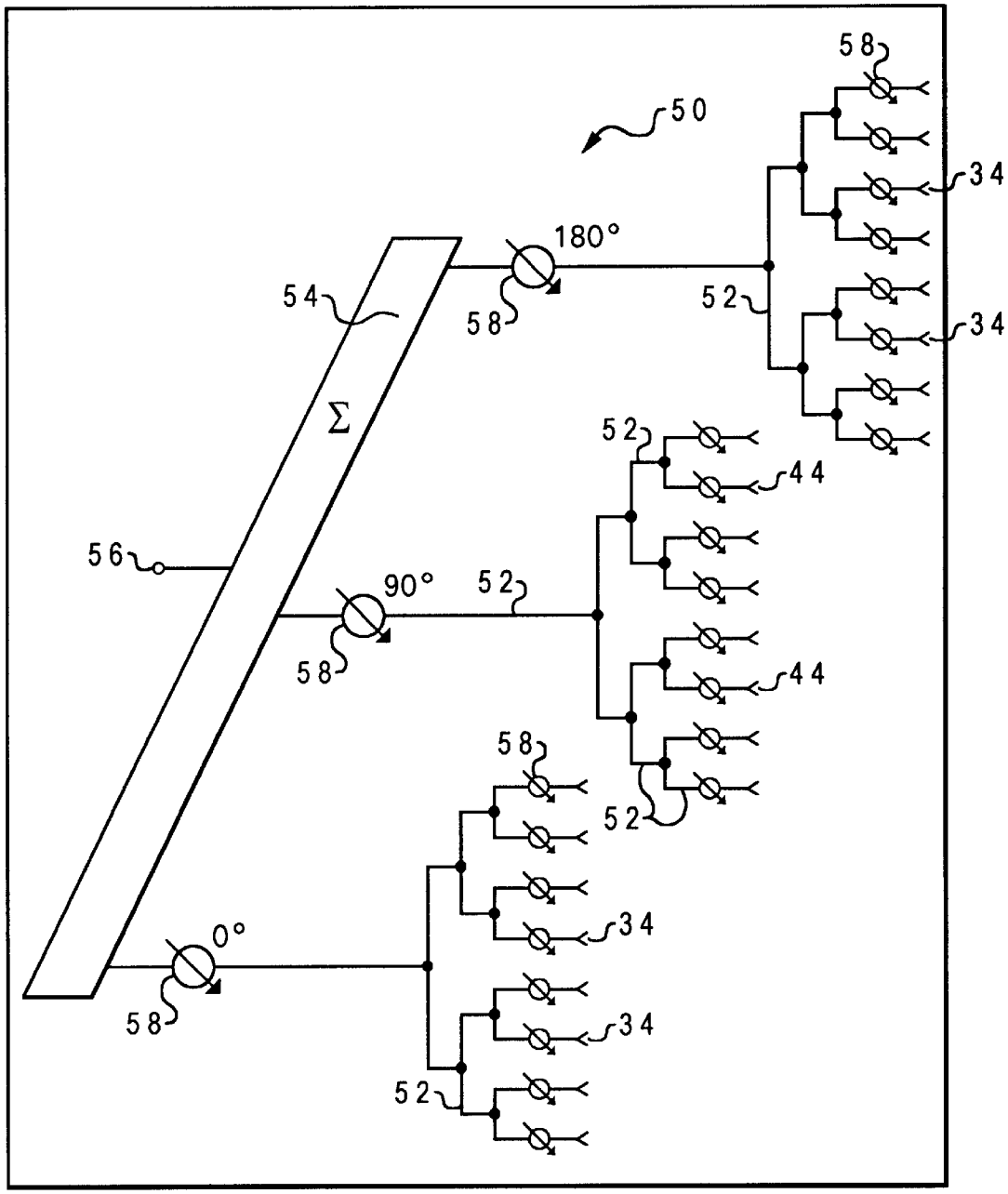
FIG. 5 is a schematic representation of a radiating element feed mechanism for use with the low profile antenna assembly shown in FIG. 3.

Referring now to FIGS. 4 and 5, the flush mounting radiating elements 34 can be fed by a etched microstrip feed mechanism 50 defined by electrical lengths of copper microstrip 52 (element feed lines) etched on the back side 48 of the printed circuit board substrate 26, terminating into an etched combiner 54. Also, as shown in FIG. 4A, another preferred embodiment has the microstrip feedlines 52 etched on the same side of printed circuit board substrate 26 supporting the flush radiating elements 34 and connected to the flush radiating elements by etched feedlines 53 also on the same side of printed circuit board substrate 26. All of the copper microstrip feedlines 52 are collected in an etched combiner 54 at the bottom of the array where an N or DIN type connector 56 is used for attachment to an external RF coax connector. It should be appreciated that the copper etchings have to be sized (width and depth) to handle the required power levels without significant degradation over years of operation. Referring once again to FIG. 4, the microstrip feedlines 52 are electrically connected to the square individual copper elements 34 by use of feed through pins 40 placed through the printed circuit board substrate 26 and are soldered in place. Although not shown, it may also be envisioned that the electrical connection can also be made through capacitive coupling.

Referring once again to FIG. 5, the radiating element feed mechanism 50 produces a beam forming network that in the preferred embodiment utilizes time delay by changing the electrical lengths of the microstrip feedlines 52 during etching to introduce phase delay to the array radiating elements 34 and permanently scan the mainlobe of the antenna in the horizontal and vertical planes. Therefore, offsetting the mainlobe or main beam in the horizontal or vertical direction is simply accomplished by changing the length of the stripline etch feeding the individual radiating elements. This changes the inherent phase front radiated or received causing the beam peak to shift in space. Once the microstrip feedlines 52 are etched, the offset is permanent for that array 44 (network optimization). In the preferred embodiment, the etched time delay changes the phasing of the radiating elements 34 to scan the array 44 left or right of the horizontal boresight up to thirty (30) degrees or electrically down which tilts the array by up to eight (8) degrees.

Figure 5A:
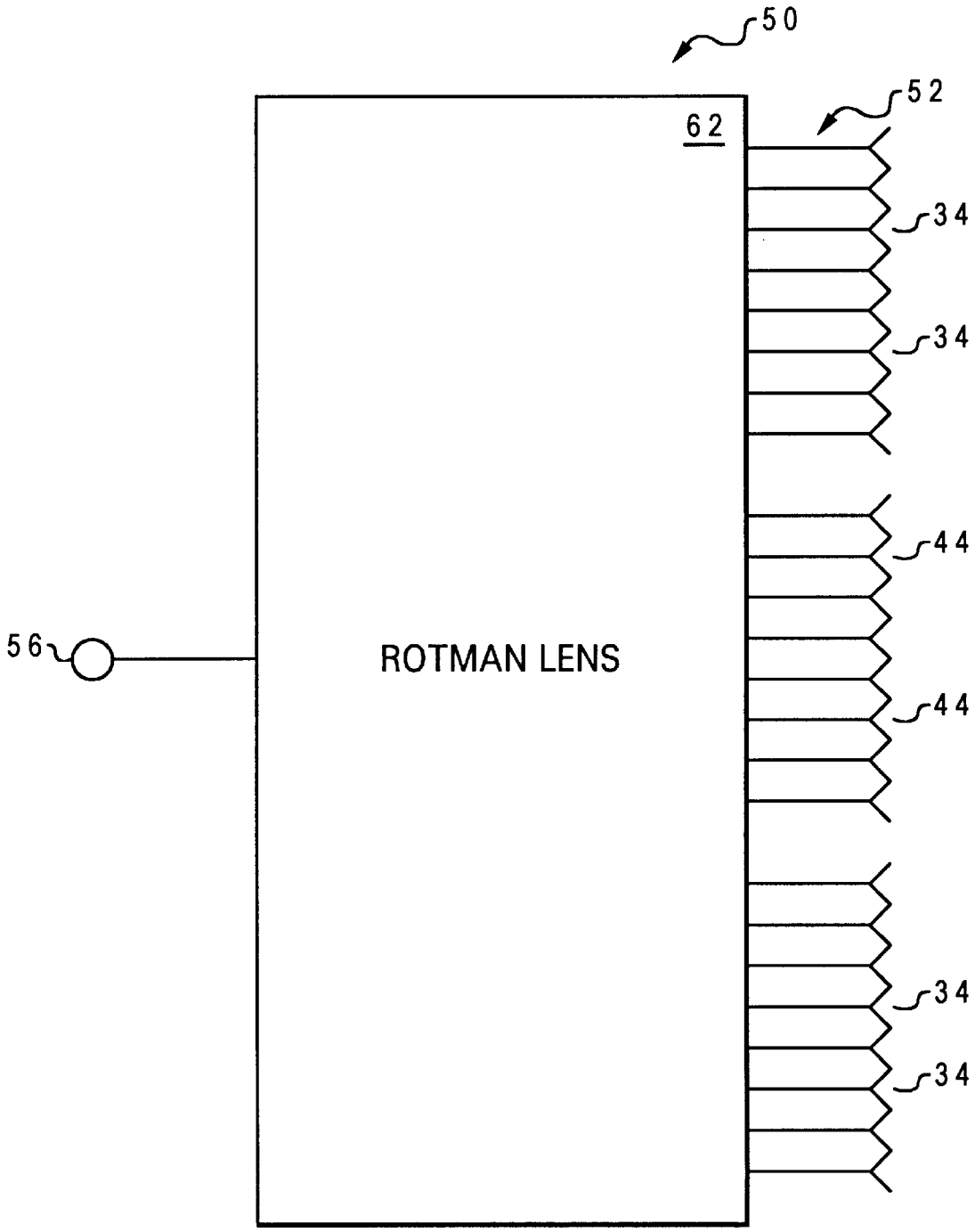
FIG. 5A is a block diagram representation of a radiating element feed mechanism for use with the low profile antenna assembly shown in FIG. 3.

Referring once again to FIG. 5, in another preferred embodiment, a method for shifting the mainlobe is to build in electrical phase shifters 58 into the substrate at the microstrip feedlines 52 connections thereby allowing the phase to be set without changing the length of the feedlines. Beam direction is set by simply switching a specific set of phase shifts into operation creating a phase front causing the mainlobe to scan in space. A more expensive Beam Forming Network (BFN) would be required for real time beam steering applications. In yet another preferred embodiment, a method for shifting the mainlobe is by use of a "Rotman" lens 62 (FIG. 5A) in association with the microstrip feedlines 52, which, once again creates a phase front causing the mainlobe to scan in space. In the preferred embodiment, the radiation pattern sidelobes of the array 44 are further reduced through the use of power amplitude tapering across the array 44. It may be envisioned that power tapering the amplitude is accomplished by adding attenuation in the microstrip feedlines 52 path to the outer elements 34. This causes more power to be radiated or collected from the center elements 34 of the array 44, thus reducing the sidelobe levels.

In another preferred embodiment, the mainlobe can be offset by as much as 45–50 degrees, however, this is for 3 sector sites and increases the sidelobe levels, (i.e., using the antenna for its low visual profile characteristics only). Additionally, the antenna array 44 can be fairly small with a larger mainlobe width (60–120 degrees) and still retain its flat and low visual profile characteristics. The physical characteristics of the present invention provide a low profile antenna that can be directly mounted to a building wall without expensive swivel bracketry. Additionally, the antenna assembly 18 can be painted with an RF transparent paint to match the building color thus lessening the antenna's visual impact (camouflage) making it virtually invisible to observers at any significant distance, thereby easing site acquisition concerns.

Figure 6:
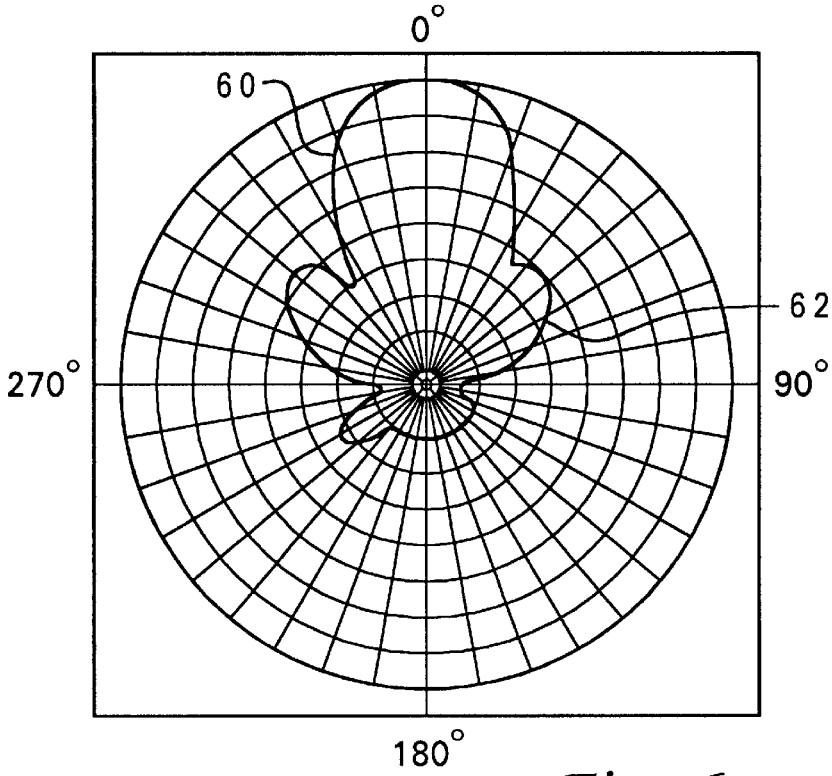
FIG. 6 is a radiation pattern in a horizontal plane in accordance with the present invention.
Figure 7:
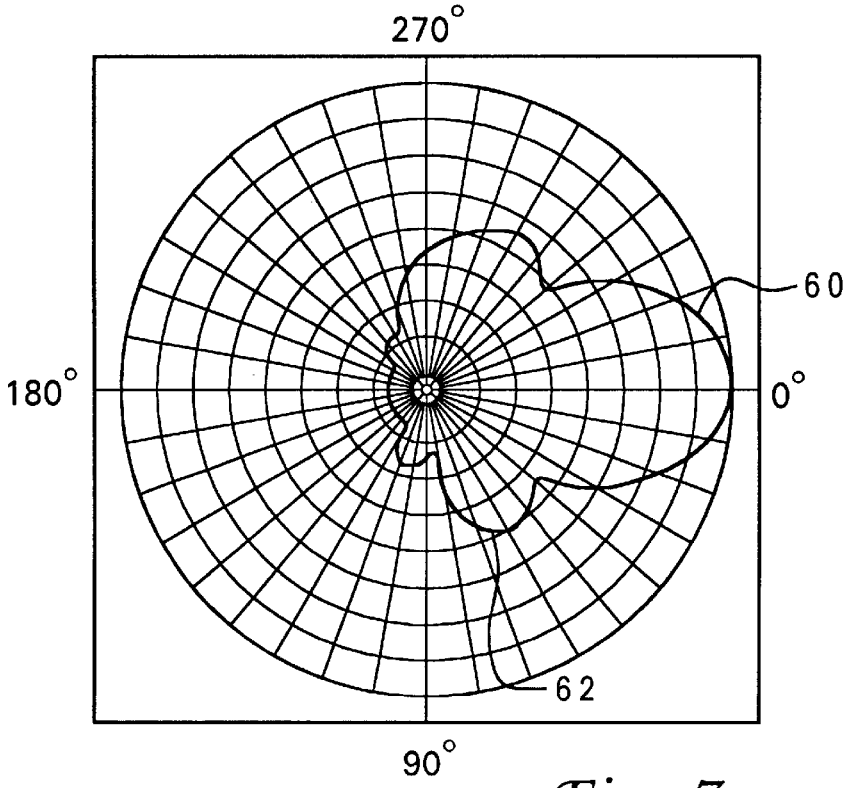
FIG. 7 is a radiation pattern in a vertical plane in accordance with the present invention.

The sectored antenna configurations of the present invention are used in system applications having 6 or more sectors. This requires the development of narrow beamwidth antennas with well-behaved sidelobe performance. Referring now to FIGS. 6 and 7, In the preferred embodiment, the low profile antenna assembly 18 will have a mainlobe peak gain of 12–22 dBi, a horizontal beamwidth 60 from 20 to 50 degrees at the −3 dB points, a vertical beamwidth 62 from 6 to 30 degrees at the −3 dB points, and a sidelobe 64 peak gain at least 17 dB below the mainlobe peak gain in both the horizontal and vertical planes. Additionally, in the preferred embodiment, the low profile antenna assembly 18 will have a mainlobe, that is permanently or adjustably scanned as much as +/−30 degrees off boresight in the horizontal plane when the electrical lengths of the microstrip feedlines 52 define a progressive phase front of zero, ninety and one-hundred and eighty degrees across the antenna planar array 44. In another preferred embodiment, the low profile antenna assembly 18 will have wider horizontal beamwidth versions of 60 to 120 degrees. This antenna being useful for building applications of 2 or 3 sectored BTS implementations where the antennas low visual impact facilitates site acquisition. Additionally, a wider beamwidth antenna requires the capability to scan the mainbeam horizontally by as much as 45 degrees.

While the invention has been particularly shown and described with reference to a preferred embodiment, it will be understood by those skilled in the art that various changes in form and detail may be made therein without departing from the spirit and scope of the invention.

What is claimed is:

1. A low profile antenna assembly for use in cellular communications comprising:

a generally rectangular frame member having mounting means for placement against a building surface;

an antenna planar array having front and back sides, said front side defining flush mounting radiating elements and said back side being covered by a radar absorbing material, said antenna planar array and said radar absorbing material housed within said frame member; and a radome covering said front side of said antenna planar array and attached to said frame member wherein said antenna assembly is painted and mounted to said building surface for camouflaging said antenna assembly from observers at a distance.

2. A low profile antenna assembly according to claim 1, wherein said flush mounting radiating elements are generally square individual copper elements etched on a first side of a printed circuit board substrate to form an array;

said flush mounting radiating elements having a radiating element feed mechanism defined by electrical lengths of microstrip feedlines etched on a second side of said printed circuit board substrate and terminating into an etched combiner, said combiner having an output for attachment to a coax connector, wherein said microstrip feedlines are electrically connected to said square individual copper elements by use of pins placed through said printed circuit board substrate and soldered in place and said radiating element feed mechanism defines a beam forming network.

3. A low profile antenna assembly according to claim 2, wherein said antenna planar array defines a mainlobe which is adjustably scanned in a horizontal plane and a vertical plane by changing said electrical lengths of said microstrip feedlines thereby creating a phase front causing said mainlobe to scan in space.

4. A low profile antenna assembly according to claim 2, wherein said antenna planar array defines a mainlobe which is adjustably scanned in a horizontal plane and a vertical plane by inserting phase shifters along said electrical lengths of said microstrip feedlines wherein changing said phase shifters creates a phase front causing said mainlobe to scan in space.

5. A low profile antenna assembly according to claim 2, wherein said antenna planar array further defining a plurality of sidelobes which are lower in power than said mainlobe by attenuating and tapering amplitude along said electrical lengths of said microstrip feedlines.

6. A low profile antenna assembly according to claim 2, wherein said antenna planar array defines a mainlobe which is adjustably scanned left and right of boresight by approximately thirty degrees in a horizontal plane when said electrical lengths of said microstrip feedlines define a progressive phase front of zero, ninety and one-hundred and eighty degrees across said antenna planar array.

7. A low profile antenna assembly according to claim 1, wherein said flush mounting radiating elements are generally square individual copper elements etched on a first side of a printed circuit board substrate to form an array;

said flush mounting radiating elements having a radiating element feed mechanism defined by electrical lengths of microstrip feedlines etched on a second side of said printed circuit board substrate and terminating into an etched combiner, said combiner having an output for attachment to a coax connector, wherein said microstrip feedlines are electrically connected to said square individual copper elements by use of capacitive coupling and said radiating element feed mechanism defines a beam forming network.

8. A low profile antenna assembly according to claim 1, wherein said antenna assembly is weatherproofed by attaching a gasket along an edge of said frame member, said frame member including a plurality of drain holes and applying a low loss phase transparent spray coating to said antenna planar array and said radar absorbing material.

9. A low profile antenna assembly according to claim 1, wherein said antenna planar array is defined by a cavity backed slot array.

10. A low profile antenna assembly according to claim 1, wherein said antenna assembly is weatherproofed by attaching a gasket along an edge of said frame member and applying a low loss phase transparent spray coating to said antenna planar array and said radar absorbing material.

11. A low profile antenna assembly according to claim 1, wherein said microstrip antenna defines a mainlobe which is adjustably scanned left and right of boresight by approximately thirty degrees in a horizontal plane when said electrical lengths of said microstrip feedlines define a progressive phase front of zero, ninety and one-hundred and eighty degrees across said microstrip antenna.

12. A low profile antenna assembly for use in cellular communications comprising:

a generally rectangular frame member having mounting means for placement against a building surface;

a microstrip antenna having individual copper elements etched on a first side of a printed circuit board and connected to each other by etched first copper striplines forming an array and a feed mechanism defined by microstrip feedlines etched on a second side of said printed circuit board and terminating into an etched combiner, said combiner having an output for attachment to a coax connector, said microstrip feedlines being electrically connected to said copper elements by use of pins placed through said printed circuit board, said feed mechanism defining a beam forming network for scanning a mainlobe of said microstrip antenna in a horizontal plane;

a radar absorbing material covering said second side of said printed circuit board, said microstrip antenna and said radar absorbing material affixed within said frame member; and a radome covering said first side of said printed circuit board and attached to said frame member wherein said antenna assembly is painted and mounted to said building surface for camouflaging said antenna assembly from observers at a distance.

13. A low profile antenna assembly according to claim 12, wherein said mainlobe is adjustably scanned in said horizontal plane by changing electrical lengths of said microstrip feedlines creating a phase front causing said mainlobe to scan in space.

14. A low profile antenna assembly according claim 12, wherein said mainlobe is adjustably scanned in said horizontal plane by use of a "Rotman" lens in association with said microstrip feedlines creating a phase front causing said mainlobe to scan in space.

15. A low profile antenna assembly according to claim 12, wherein said mainlobe is adjustably scanned in said horizontal plane by inserting phase shifters along said microstrip feedlines wherein changing said phase shifters creates a phase front causing said mainlobe to scan in space.

16. A low profile antenna assembly according to claim 12, wherein said microstrip antenna further defines a plurality of sidelobes which are lower in power than said mainlobe by attenuating and tapering amplitude along said microstrip feedlines.

17. A low profile antenna assembly according to claim 12, wherein said mainlobe is adjustably scanned in a vertical plane by changing electrical lengths of said microstrip feedlines creating a phase front causing said mainlobe to scan in space.

18. A low profile antenna assembly according to claim 12, wherein said microstrip antenna having an array configuration to produce a mainlobe having a peak gain approximately between 12 and 22 dBi, said mainlobe further having a horizontal beamwidth approximately between 20 to 50 degrees at −3 dB points and having an elevation beamwidth approximately between 6 to 30 degrees at −3 dB points and a sidelobe peak gain at least 17 dB below said mainlobe peak gain.

19. A low profile antenna assembly according to claim 12, wherein said microstrip antenna having an array configuration to produce a mainlobe having a horizontal beamwidth approximately between 60 to 120 degrees at −3 dB and is adjustably scanned left and right of boresight by approximately forty-five degrees in a horizontal plane when electrical lengths of said microstrip feedlines define a progressive phase front of zero, ninety and one-hundred and eighty degrees across said antenna planar array.

20. A low profile antenna assembly for use in cellular communications comprising:

a generally rectangular frame member having mounting means for placement against a building surface; a microstrip antenna having square individual copper elements etched on a first side of a printed circuit board and connected to each other by etched first copper striplines forming an array having at least three columns and a feed mechanism defined by electrical lengths of microstrip feedlines etched on a second side of said printed circuit board and terminating into an etched combiner, said combiner having an output for attachment to a coax connector, said microstrip feedlines being electrically connected to said square individual copper elements by use of pins placed through said printed circuit board;

said feed mechanism defining a beam forming network for scanning a mainlobe of said microstrip antenna approximately thirty degrees left and right of boresight in a horizontal plane, said mainlobe adjustably scanned by changing electrical lengths of said microstrip feedlines to define a progressive phase front of zero, ninety and one-hundred and eighty degrees across said microstrip antenna and scanning said mainlobe in a vertical plane by further changing said electrical lengths of said microstrip feedlines;

said microstrip antenna further defining a plurality of sidelobes that are lower in power than said mainlobe by attenuating and tapering amplitude along said electrical lengths of said microstrip feedlines;

a radar absorbing material covering and attached to said second side of said printed circuit board, said microstrip antenna and said radar absorbing material affixed within said frame member; and a radome covering said first side of said printed circuit board and attached to said frame member wherein said antenna assembly is weatherproofed by attaching a rubber gasket along an edge of said frame member and applying a low loss phase transparent spray coating to said antenna planar array and said radar absorbing material and painting said antenna assembly to match said building surface wherein said frame member is mounted to said building surface for camouflaging said antenna assembly from observers at a distance.

21. A low profile antenna assembly for use in cellular communications comprising:

a generally rectangular frame member having mounting means for placement against a building surface;

a microstrip antenna having individual copper elements etched on a first side of a printed circuit board and connected to each other by etched first copper striplines forming an array and a feed mechanism defined by microstrip feedlines etched on said first side of said printed circuit board and terminating into an etched combiner, said combiner having an output for attachment to a coax connector, said microstrip feedlines being electrically connected to said copper elements by use of etched feed lines on said first side of said printed circuit board, said feed mechanism defining a beam forming network for scanning a mainlobe of said microstrip antenna in a horizontal plane;

a radar absorbing material covering a second side of said printed circuit board, said microstrip antenna and said radar absorbing material affixed within said frame member; and a radome covering said first side of said printed circuit board and attached to said frame member wherein said antenna assembly is painted and mounted to said building surface for camouflaging said antenna assembly from observers at a distance.

* * * * *